United States Patent [19]

Nechay et al.

[11] Patent Number: 4,832,783

[45] Date of Patent: May 23, 1989

[54] APPARATUS FOR ROTATIONAL DECORATION OF ARTICLES

[75] Inventors: Jack A. Nechay, Northboro; Fritz E. Bauer, Shrewsbury; Bernard R. Danti, Lexington, all of Mass.; Mark Lukkarinen, Merrimack, N.H.

[73] Assignee: Dennison Manufacturing Company, Framingham, Mass.

[21] Appl. No.: 131,482

[22] Filed: Dec. 7, 1987

Related U.S. Application Data

[62] Division of Ser. No. 750,447, Jul. 1, 1985, Pat. No. 4,732,641.

[51] Int. Cl.[4] ..... B65C 9/04; B65C 9/00; B44C 1/00

[52] U.S. Cl. ..... 156/448; 156/458; 156/486; 156/542; 156/567; 156/DIG. 39

[58] Field of Search ..... 156/361, 448, 458, 486, 156/521, 540, 541, 542, 571, 584, 230, 241, 247, 249, 344, DIG. 3, DIG. 11, DIG. 13, DIG. 30, DIG. 33, DIG. 39, DIG. 42

[56] References Cited

U.S. PATENT DOCUMENTS

| | | | |
|---|---|---|---|
| 2,384,241 | 9/1945 | Elsner | 156/578 |
| 2,520,628 | 8/1950 | Elsner | 156/571 |
| 4,032,388 | 6/1977 | Dunning | 156/567 |
| 4,203,798 | 5/1980 | Yamashita | 156/567 |
| 4,253,902 | 3/1981 | Yada | 156/361 |
| 4,313,994 | 2/1982 | Kingston | 428/200 |
| 4,323,416 | 4/1982 | Malthause | 156/521 |
| 4,332,635 | 6/1982 | Holbrook et al. | 156/521 |
| 4,336,095 | 6/1982 | Hoffman | 156/542 |
| 4,383,880 | 5/1983 | Geurtsen et al. | 156/361 |
| 4,475,969 | 10/1984 | Reed | 156/249 |
| 4,511,425 | 4/1985 | Boyd et al. | 156/542 |

*Primary Examiner*—Michael W. Ball
*Assistant Examiner*—Louis Falasco
*Attorney, Agent, or Firm*—Arthur B. Moore

[57] ABSTRACT

Application of heat transfer labels to articles. A roller having a smooth elastomeric coating turns against a moving web. The web carries heated labels which are transferred to the roller. The roller, with a transferred label thereon, turns against a moving article, and transfers the label to same. The elastomeric coating conforms to the article surface.

19 Claims, 11 Drawing Sheets

APPARATUS FOR ROTATIONAL DECORATION OF ARTICLES

This is a division of Ser. No. 750,447, filed July 1, 1985, now U.S. Pat. No. 4,732,641.

BACKGROUND OF THE INVENTION

The present invention relates to heat transfer decorations, and more particularly to heat transfer decorators having an intermediate transferring element.

A popular type of heat transfer decorator is shown and described in U.S. Pat. Nos. 4,452,659; 4,383,880; and 4,381,211. These decorators apply labels disposed on a web and prepared in accordance with, for example, U.S. Pat. Nos. 4,426,422, and 4,313,994. A turret for conveying article past a labelling site is shown and described in U.S. Pat. Nos. 4,405,403. A web transport assembly is shown and described in U.S. Pat. No. 4,411,393.

In these decorators the web is heated causing the label to become loosely adhered thereto. A platen containing a roller moves forward pressing the web against the article to be decorated. The article is rotated if round, or conveyed if non-round, as the web is advanced. The heat causes the outer surface of the label to become tacky, consequently, the label adheres to the article. After the label has been transferred, the label surface is subjected to high temperatures, causing the waxy release layer to become smooth.

A decorating system for applying labels to articles having compound or irregular surfaces is shown and described in pending application Ser. No. 503,486. This decorator cooperates with a different label, shown and described in U.S. Pat. No. 4,392,905 and pending application U.S. Ser. No. 660,264. A heated elastomeric pad is pressed against the web to remove the label, moved into position above the article, then pressed against the article to apply the label. The pad can deform to enter folds and can wrap around projections.

A number of advantages are obtained with the use of the '905 type label, including: elimination of wax surface on the label; a combination release/adhesive layer; scratch/abrasion resistance; elimination of postflaming; and variation of the chemical composition of the label surface.

Accordingly, it is an object of the present invention to provide a new decorator which can reliably apply the '905 type label at high speed.

SUMMARY OF THE INVENTION

In accomplishing the foregoing and related objects, the invention provides a roller having an elastomeric surface, positionable between an article to be decorated and a high temperature platen. The intermediate roller serves as a transferring member, and permits the high speed application of labels.

In accordance with one aspect of the invention, the roller and associated elements are configured to be readily and easily installed in prior art decorating machines which were originally designed to apply heat transfer labels of the type disclosed, for example, in U.S. Pat. No. 3,616,015. The invention thus may serve as either a retrofit kit, or as original equipment, and enables the application of heat transfer labels of the type shown and described in U.S. Pat. No. 4,392,905 and U.S. Ser. No. 660,264. The '905 type label offers a number of advantages. The label chemistry includes a combination release layer/adhesive layer. This layer contains no wax, common in heat transfer labels. As a result, label appearance is enhanced, while postflaming (to smoothen the label surface and improve adhesion) is no longer required. Additionally, the '905 label can be provided with varying outer surfaces, for example, surfaces which resist damage from alcohol or other chemicals, or which provide abrasion resistance.

In accordance with another aspect of the invention, assemblies for supporting, rotating, and positioning the roller are provided. In the Prior art, the label is transferred directly from the carrier member, or web, to the article to be decorated. The '905 label requires transfer to an intermediate surface prior to application to the article. Accordingly, the roller is rolled against the carrier member and the article, whereby the label transfers from the web, to the roller, and then to the article.

The roller includes a cylinder coated with an elastomeric material, such as silicone rubber. The surface is heated by external or internal heaters. In the internally heated embodiment, the cylinder rotates about a stationary heater core.

In a preferred embodiment, the support assembly includes a base, a pivot, and upper and lower support arms. The upper arm is adjustable to accommodate varying roller heights. A linking arm cooperates with a timing cam to pivot the arms thus positioning the roller between the platen and the article.

A drive assembly is provided to rotate the roller in a reciprocating manner. A rack is mounted to a timed member. A spur gear mates with the rack and supports a pulley. The pulley is replaceable to enable rotation of the roller at different speeds for different applications. A belt couples the pulley to a drive shaft assembly.

The drive shaft assembly is provided to couple the drive assembly to the roller. An input pulley is coupled to the drive assembly belt and is mounted on an inner shaft. An outer shaft is disposed about the inner shaft and is coupled to the inner shaft by a detent assembly. The axis of the inner and outer shafts are approximately coaxial with the support pivot. A pulley couples the outer shaft to the roller via a belt. The drive shaft assembly provides positive coupling yet is infinitely variable via a replaceable pulley.

During a portion of the non-round article labelling cycle, the roller must be rapidly rotated. To achieve this, a rapid rotation assembly is provided. An advance arm cooperates with a timed member to pivot about a shaft. A swivel bracket is rotatably mounted to the outer shaft, and is pivotally connected to a link, which is in turn pivotally connected to the end of the advance arm. A ratchet is attached to the outer shaft. As the advance arm is pivoted, a pawl coupled to the swivel bracket engages the ratchet. The ratchet causes the outer shaft to rotate faster than the inner shaft, thus breaking a detent clutch. As the advance arm returns, a pawl lifting arm, cooperative with the advance arm, lifts the pawl out of engagement with the ratchet. In this manner, the inner and outer shafts recouple via another position of the detent clutch.

In accordance with a further aspect of the invention, the above described elements cooperate to enable decoration of round and non-round containers, typically bottles. In the decoration of non-round articles, the label is transferred to the roller first, and is subsequently applied by the roller to the article to be decorated.

In the decoration of articles, a web prepared in accordance with, for example, U.S. Pat. No. 4,392,905, is passed over a preheater and platen whereby the label becomes loosely adhered to the web and the outermost surface becomes tacky. In the decoration of non-rounds, the linking arm pivots the support towards the web and the transfer roll comes forward, thus causing the roller to contact the web. The roller is driven by the drive assembly at web velocity against the moving web, wherein the label is transferred to the roller, from trailing edge to leading edge (as shown in FIG. 6, from edge B to A). The label is then transferred to the article from edge A to edge B. As a result, edge A must be positioned adjacent the initial contact point on the article. The rapid rotation assembly carries out this positioning by rotating the roller approximately 180 degrees, during the brief time period wherein the linking arm is pivoting the support towards the article. The roller next turns against the non-round article as same is conveyed by the turret, thus transferring the label to the article.

In the decoration of round articles, the rapid rotation assembly is disenabled. The roller is first positioned in contact with the article. Next, the platen moves forward pressing the web against the opposite side of the roller. As the web advances, the roller rotates counterclockwise, as viewed from above, while the article is rotated clockwise. Edge B of the label first transfers to the roller and then to the article when it reaches the tangential line of contact between the roller and the article. As a result, the label is transferred to the article in a continuous manner. This process can thus be used to transfer labels of length greater than the circumference of the roller. Therefore, a roller having a small diameter may be employed.

In a further aspect of the invention, the elements of the present invention enable the use of existing heat transfer decorating equipment for the application of the '905 type label.

In accordance with yet another aspect of the invention, articles having linear or non-linear surfaces can be reliably decorated by the compliant intermediate roller.

BRIEF DESCRIPTION OF THE DRAWINGS

FIGS. 6*a* through 6*i* are sequential schematic views showing the events in labeling a non-round article, wherein:

FIG. 6*a* shows the contact of the platen assembly with the web,

FIG. 6*b* shows the end of the shuttle stroke,

FIG. 6*c* shows the period of rapid roller rotation prior to contacting the article, FIG. 6*d* shows the pivoting of the roller toward the article, FIG. 6*e–g* shows roller rotation against the article, FIG. 6*h–i* show separation of the article from the roller;

DETAILED DESCRIPTION

Figure 1:
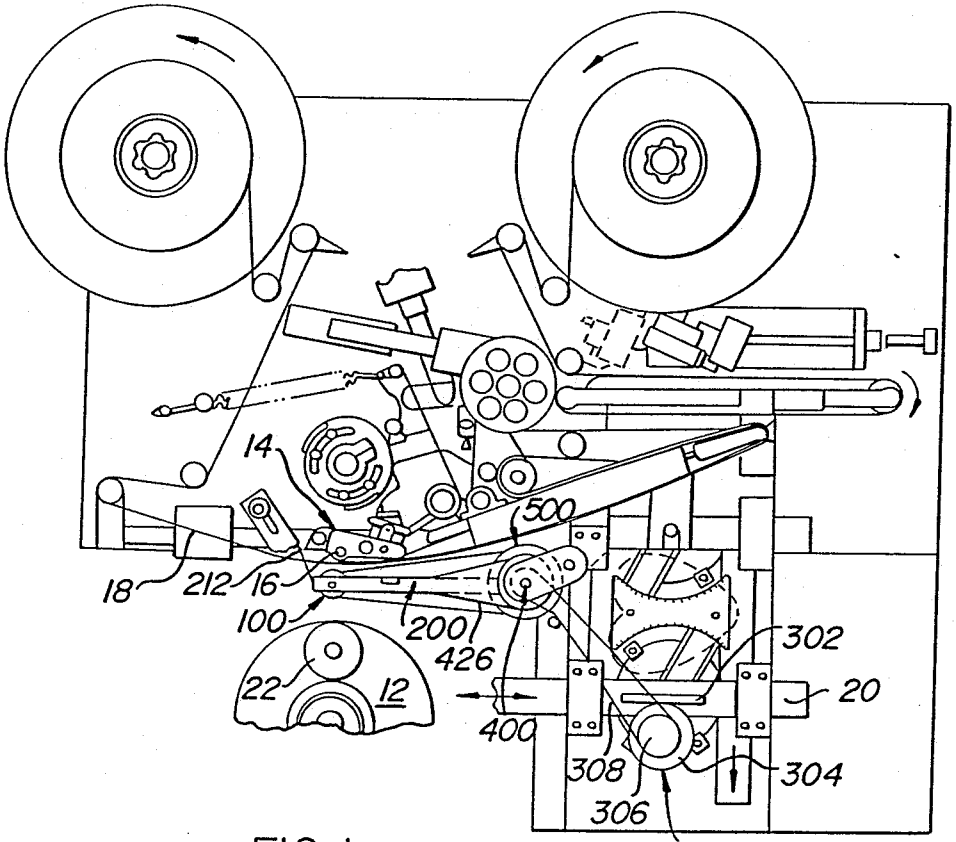
FIG. 1 is a top plan view of the elements of the present invention in a heat transfer decorator.

Reference should be had to the accompanying drawings for a detailed description of the invention. With reference to FIG. 1, a preferred embodiment of the invention includes roller 100; support 200; drive assembly 300; drive shaft assembly 400; and rapid rotation assembly 500 The elements of the invention are designed to be easily installed as a retrofit kit in the existing, above described decorating equipment. Alternatively, the invention may comprise a complete decorator, to be provided as original equipment. Roller 100 acts as an intermediate surface wherein the label is transferred to roller 100 and then is applied to the article. Support 200 pivots the rotating roller between the web and an article to be decorated. Drive assembly 300 couples to the existing timed drive mechanism of the decorator, and causes the roller to bi-directionally rotate at the desired speed. Drive shaft assembly 400 couples roller 100 to drive assembly 300 and permits decoupling therefrom to allow rapid rotation assembly 500 to overspeed roller 100 rotation. The elements which comprise each of these assemblies are described next, followed by a description of how they cooperate to decorate various articles.

ELEMENTS

ROLLER ASSEMBLY

Roller 100 is provided moveably disposed between a platen assembly 14 and a turret 12 (shown in FIG. 1). In a preferred embodiment, shown in FIG. 2, Roller 100 comprises a drive journal 102 coupled to a drive cylinder 104 having a smooth elastomeric coating 106, such as a silicone compound. Silicone is used in a preferred embodiment due to its low cost, adhesive and elastomeric properties. Moreover, silicone can be cast in a mold to form a very smooth surface and can be compounded to withstand sustained elevated temperatures without compositional degradation. A preferred durometric range is 27–40 on the Shore A scale, although a wider range may be used. The coating thickness may vary considerably, but typically is between 1/16 and $\frac{3}{4}$ inches, preferably $\frac{3}{8}$ inches. While a compliant surface offers great reliability and can be used to decorate relatively uneven surfaces, a non-compliant surface may additionally be used, provided the article has sufficient pliability for the particular application.

Drive cylinder 104 revolves on bearing surfaces 110 and 111 in close proximity about an internally disposed fixed heater core 108, having a support shaft 112. Electric heating element 113 is disposed within heater core 108, in heat transmitting contact therewith. Heat is transmitted to heater core 108, passing across a small gap to drive cylinder 104. Coating 106 warms to operational temperature, resisting minor fluctuations in temperature due to its mass and heat capacity.

Figure 3:
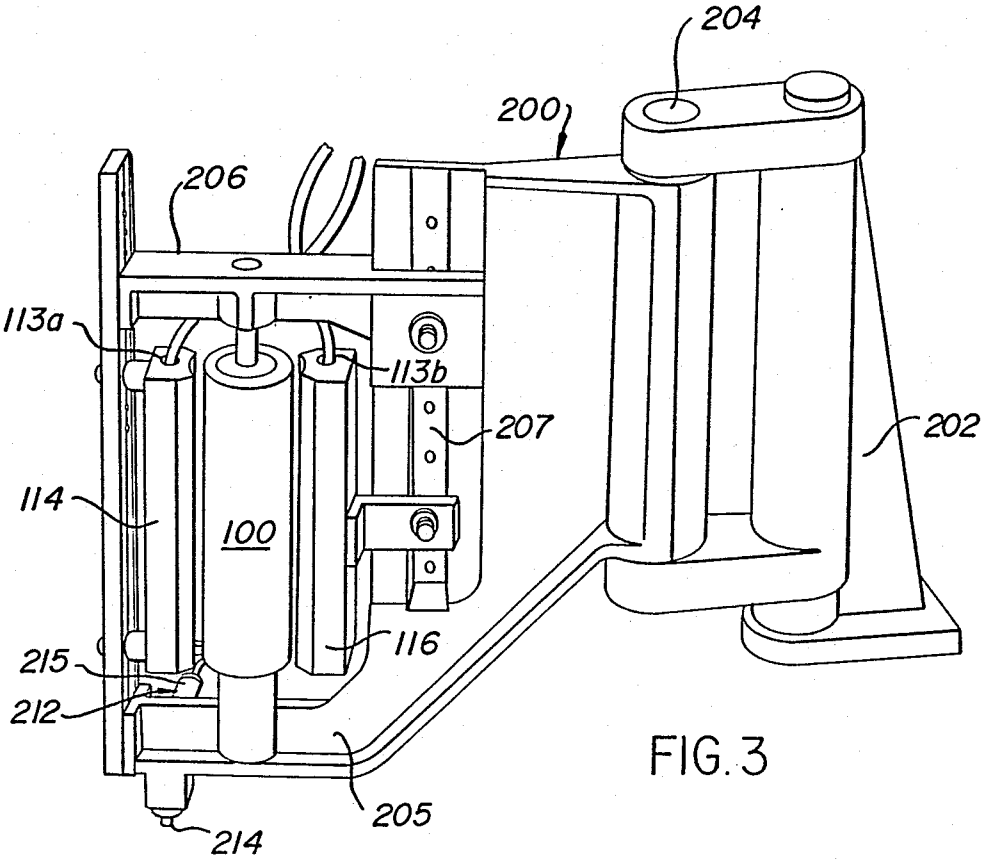
FIG. 3 is a perspective view of an externally heated roller in accordance with the present invention.

In an externally heated embodiment, shown in FIG. 3, two heating elements 113*a,b* are externally mounted inside thermal radiators 114, 116. Surface 106 is thus heated by radiators 114, 116.

SUPPORT

Figure 2:
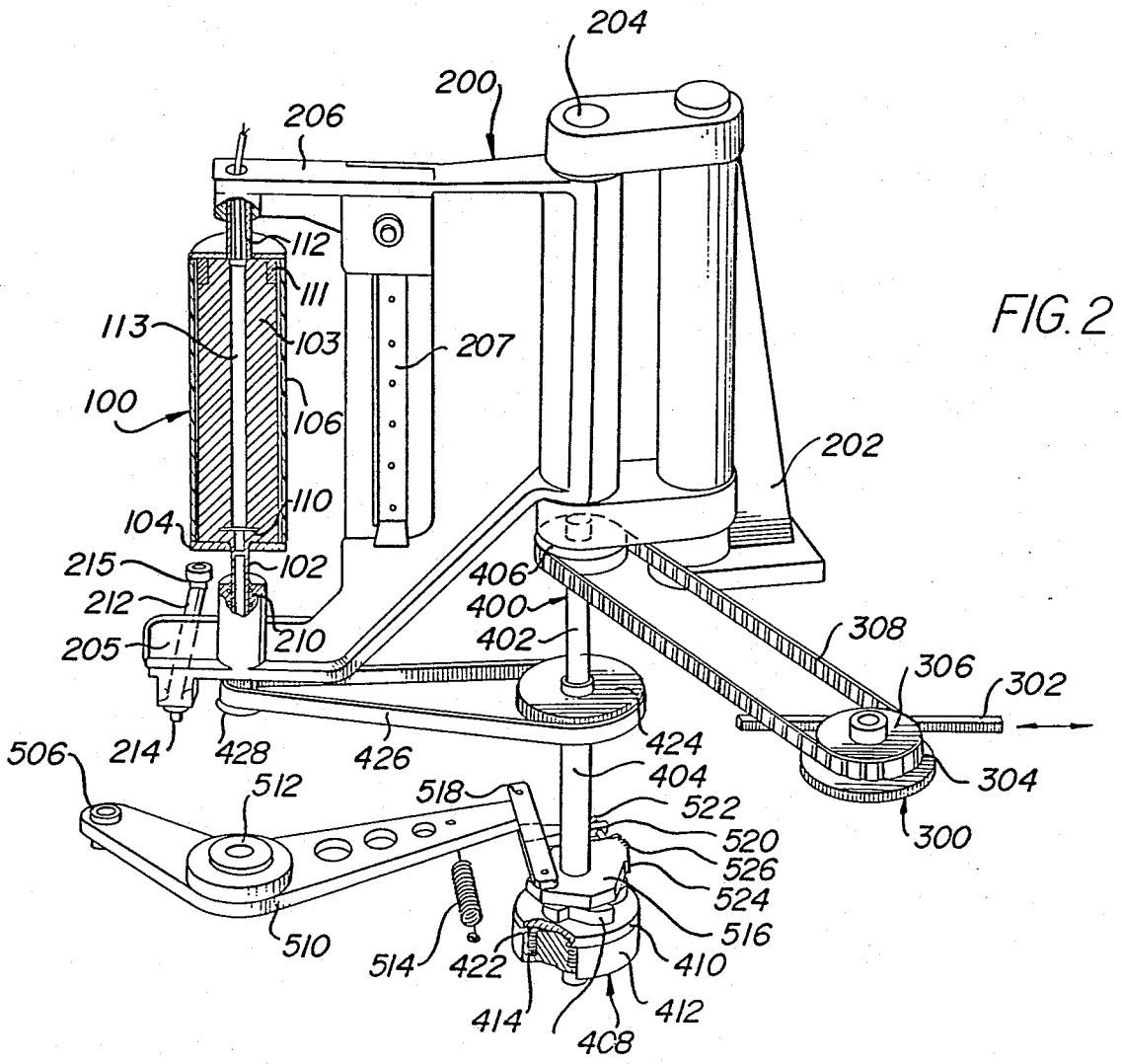
FIG. 2 is a perspective view of the elements of the present invention, with portions of the detent broken away.

As shown in FIGS. 2 and 3, a roller support 200 is provided for supporting and moving roller 100 axially during the transfer process. A base 202 supports a pivot 204. Pivot 204 has a lower support arm 205 which extends outwardly to rotatably receive drive journal 102 in bearing 210. An upper support arm 206 is adjustably mounted to key 207. Arm 206 may be raised or lowered to accommodate varying roller heights. Support 200 is pivoted axially by linking arm 212. Screw 214 couples linking arm 212 to support assembly 200.

Figure 10:
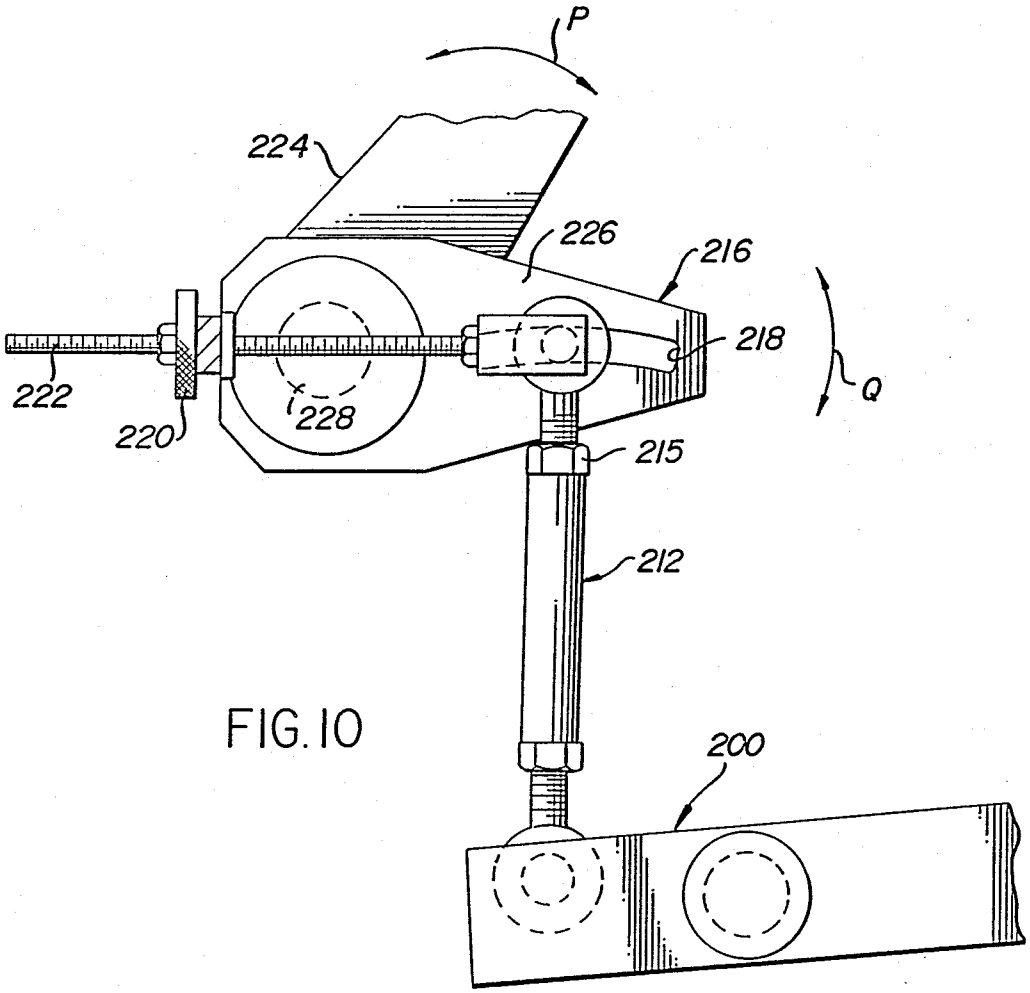
FIG. 10 is a top view of the support positioning assembly in accordance with the invention.

With reference to FIG. 10, a support positioning assembly 216 is provided, to enable the adjustment of roller/article contact pressure independently from roller/platen contact pressure. Linking arm 212 is slideably retained in a radiused slot 218. Angular disposition of linking arm 212 within slot 218 is adjusted by rotating knurled knob 220, which threadably engages rod 222, the latter coupled to linking arm 212, pivot arm 224, follows a timing cam, pivoting in the direction of arrow P. Slot bracket 226 is coupled to pivot arm 224, both members 226, 224 pivotable about the axis of pin 228. As linking arm 212 is moved within slot 218, the position of roller support 200 remains constant. Thus, turnbuckle 215 may be adjusted for proper roller/article contact pressure. Roller/platen contact pressure is then adjusted by rotating nut 220, wherein throw, indicated by arrow Q, is increased or decreased.

DRIVE ASSEMBLY

As can be seen in FIGS. 1 and 2, roller drive assembly 300 is provided to rotate roller 100 in a reciprocating manner. In a preferred embodiment, a rack gear 302 is mounted on a reciprocating shuttle 20, such as is described in U.S. Pat. No. 4,383,880. A spur gear 304 matably engages rack gear 302, wherein spur gear 304 rotates in a first direction through a portion of a revolution and then in an opposite direction through an equivalent portion of a revolution. A replaceable pulley 306 is mounted to spur gear 304 and rotates in unison therewith. A chain or belt 308 couples pulley 306 to a drive shaft assembly 400.

DRIVE SHAFT ASSEMBLY

Figure 4:
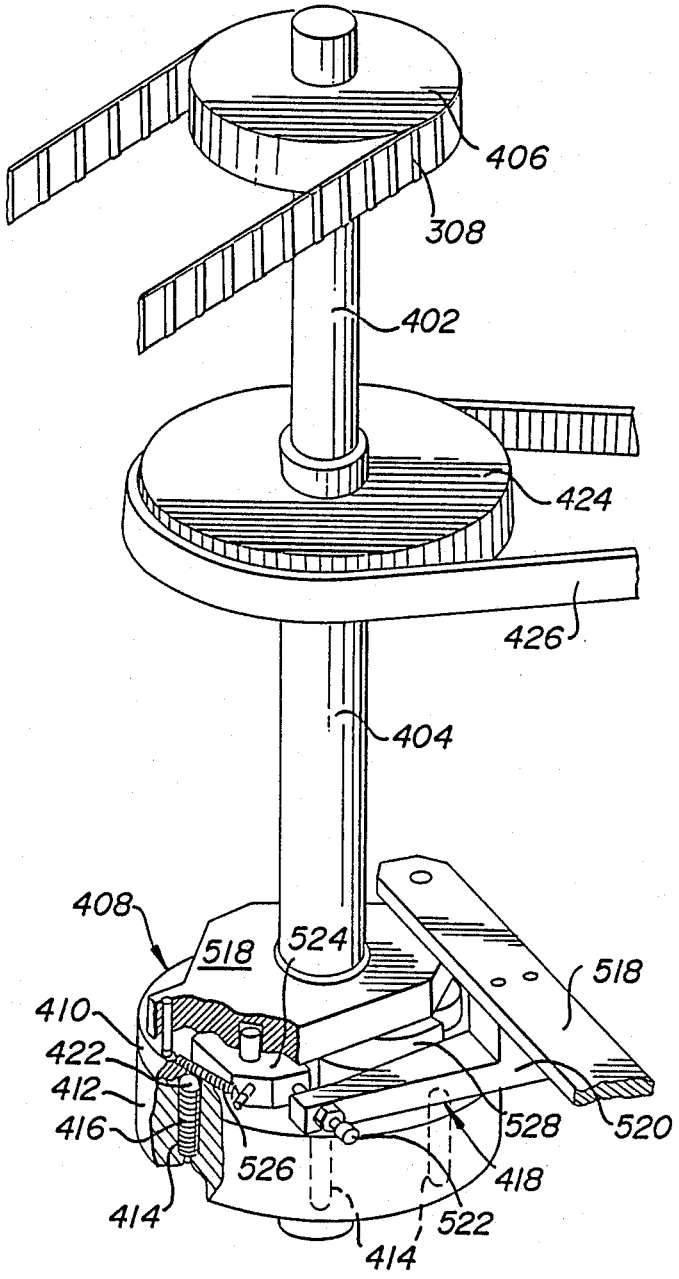
FIG. 4 is a perspective view of the drive shaft assembly as viewed from the back, with portions of the detent and swivel bracket broken away.

Drive shaft assembly 400, shown in FIG. 2 from the front and FIG. 4 from the rear, includes an inner shaft 402 and an outer shaft 404. Input sprocket 406 is coupled to inner shaft 42 and belt 308. A detent assembly 408 is disposed about the lower end of drive shaft assembly 400, comprising upper and lower segments 410 and 412. Lower segment 412 is provided with six recesses 414 spaced apart 60 degrees relative to each other. Springs 416 are disposed within recesses 414. Upper segment 410 is provided with six V-shaped grooves 418, spaced apart 60 degrees relative to each other, alignable with recesses 414. A ball 422 is positioned partially disposed within each of the six recesses 414, pressed upwards into grooves 418 by springs 416. Lower segment 412 is attached to inner shaft 402, and upper segment 410 is attached to outer shaft 404. As inner shaft 402 is rotated by transfer roller drive assembly 300 via belt 308 and sprocket 406, lower segment 412 is caused to rotate. Upper segment 410 rotates in unison via the coupling created by ball 422. Belt 426 is coupled to output pulley 424 and drive pulley 428, the latter attached to drive journal 102.

RAPID ROTATION ASSEMBLY

Figure 5:
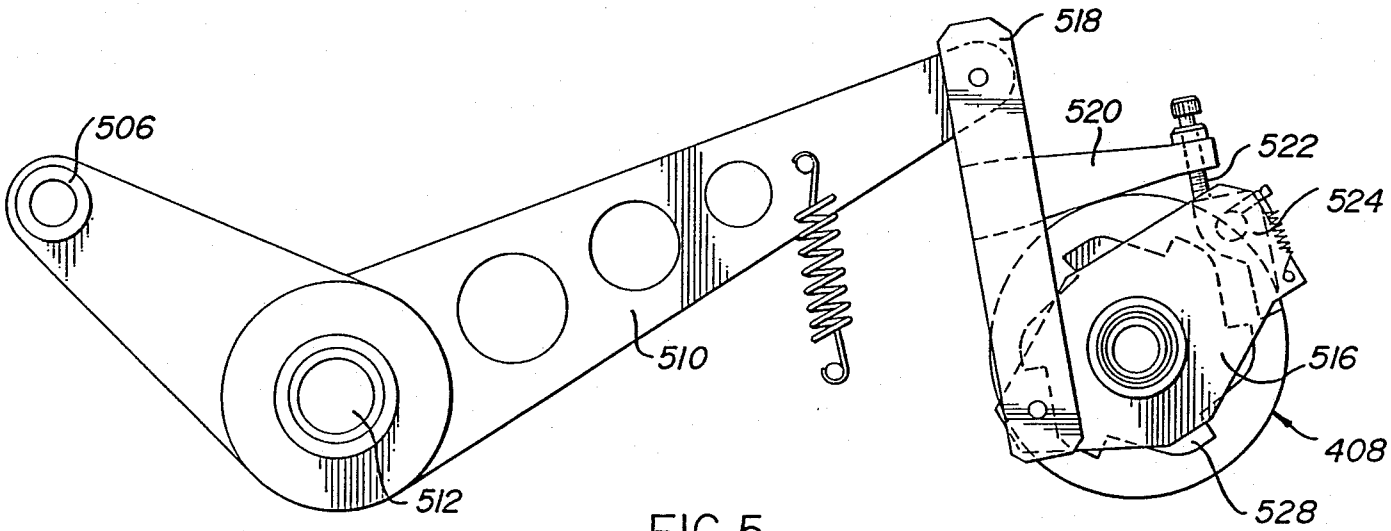
FIG. 5 is a plan view of the rapid rotation assembly.

Rapid rotation assembly 500 is provided cooperative with drive shaft assembly 400 to rotate roller 100 through a defined portion of an arc at a speed significantly in excess of the rotational speed imparted by drive assembly 300. As can be seen in FIGS. 2 and 5, advance arm 510 with cam follower 506, follows a timing cam or other timed member, pivoting on shaft 512 against a resistive force imparted by spring 514. Swivel plate 516 is rotatably disposed around outer shaft 404. Connecting arm 518 is pivotally connected at one end to advance arm 510 and at the opposite end to swivel plate 516. Pawl lifting arm 520 extends at an angle from connecting link 518. Set screw 522 is threadably maintained on the end of pawl lifting arm 520. Pawl 524 is pivotally mounted to swivel plate 518 and is urged inwards, towards outer shaft 404 by spring 526. A ratchet 528 is attached to outer shaft 404 in operational conformity with pawl 524. Set screw 522 normally maintains pawl 524 out of engagement with ratchet 528.

OPERATION

The apparatus of the present invention enables the decoration of a great variety of articles. Common applications for the '905 type label include the decoration of containers, typically plastic but including glass, ceramic, metal and other materials. These containers present a panoply of shapes and sizes, which can be categorized into two major groups for decorating with the apparatus of the invention: non-rounds, and rounds.

DECORATION OF NON-ROUND ARTICLES

With reference to FIG. 6, in the decoration of non-round articles, the label is first transferred to roller 100. At this juncture, edge B of the label is 180 degrees away from the application point on the article. During the transition from contact with the web to contact with the article, roller 100 is rotated 180 degrees to bring edge B into application alignment on the article. To carry out these steps, a number of additional events occur as follows:

A web prepared, for example, in accordance with U.S. Pat. No. 4,392,905 or copending application Ser. No. 660,264, is advanced to a labelling site and registered in a web transport system 10, such as is shown for example in U.S. Pat. No. 4 452,659. As can be seen in FIG. 1, preheater 12 raises the temperature of the web to a point near where the resinous release layer begins to melt, for example in the range of 200°–400° F., typically 250°–350° F. A platen assembly 14, located at the labelling site, further raises the temperature of web 18 so that the resinous release layer becomes molten, for example in the range of 350°–600° F., typically 390°–500° F. Generally, temperature must be adjusted for changes in environment and label type, for optimum application. As seen in FIG. 1, transfer roller 16 is supported within platen assembly 14 to freely rotate in contact with the nonlabel bearing side of web 18. The transfer roller 16 may be provided with a smooth metallic surface, as opposed to the rubber coating of U.S. Pat. No. 4,452,654.

Linking arm 212 responds to support positioning assembly 216, drawing roller 100 towards web 18. Platen 14 next moves forwards, Pressing web 18 against roller 100. At this juncture, web 18 advances, and roller 100 is rotated. Generally, the relative web/roller speed ratio is 1:1. This ratio may be varied, however, to stretch or shrink the label as required. Rotational speed of roller 100 is determined by the diameter of pulley 306.

As platen assembly 14 contacts web 18, the outermost surface of label 24 becomes tacky, FIG. 6 (*a*). Thus, as Web 18 is advanced, roller 100 turns in contact with label 24, whereupon the latter becomes loosely adhered to roller 100. At the end of the shuttle 20 stroke, the label has been completely transferred to roller 100, FIG. 6 (*b*). Linking arm 212 next causes support assembly 200 to pivot roller 100 towards article 212, FIG. 6 (*d*).

During the conveyance from web 18 to article 22, Label 24 is subject to cooling. This cooling decreases the strength of the label/roller bond, while increasing the adhesive properties of the label surface. To maintain temperature, smooth surface 106 of roller 100 is heated, for example, in the range of 120°-300° F., typically 150°-290° F. Surface 106 may be heated externally or internally. FIG. 2 shows an internally disposed heater core 108. The internally heated version offers improved temperature uniformity.

Figure 6A:
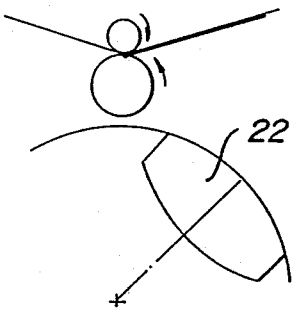
Figure 6B:
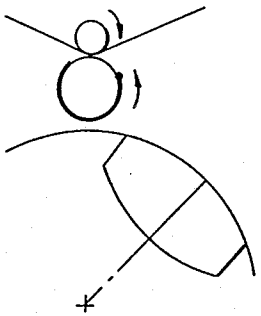
Figure 6C:
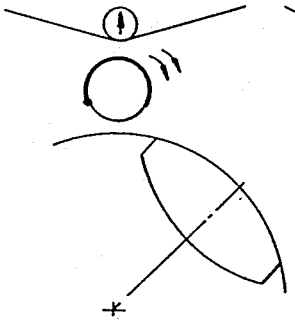
Figure 6D:
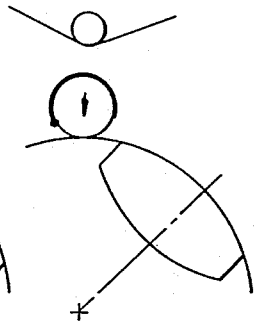
Figure 6E:
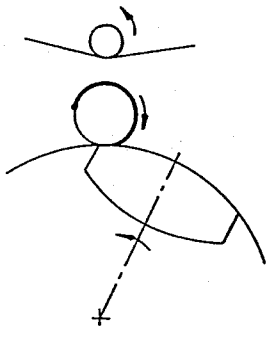
Figure 6F:
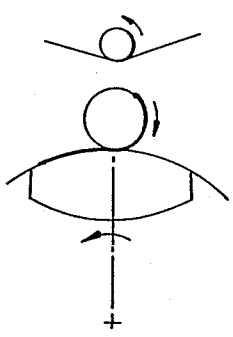
Figure 6G:
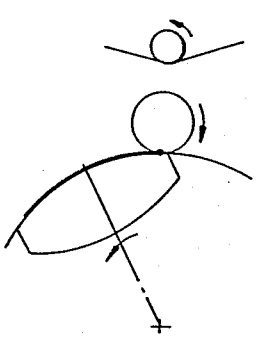
Figure 6H:
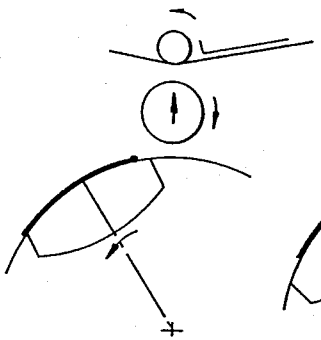
Figure 6I:
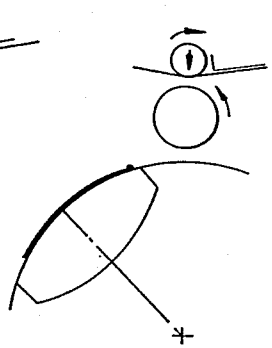

As discussed above, roller 100 must rotate approximately 180 degrees to position edge B of the label into alignment for the next transfer. The rotation must be complete before roller 100 contacts article 22. Rapid rotation assembly 500 operates as an overspeed mechanism to achieve the 180 degree rotation during this relatively brief interval. FIG. 6(C), arrow R.

As described above, set screw 522 normally maintains pawl 524 out of contact with ratchet 528. Cam 502 is timed to cause advance arm 510 to pivot on shaft 512 after the transfer of design layer 24 to roller 100. Through attachment to connecting link 518, pawl lifting arm moves set screw 522 away from pawl 524, permitting engagement with ratchet 528. As advance arm 510 continues to pivot, swivel plate 516 is caused to rotate. Pawl 524 is circumferentially driven against ratchet 528, through attachment to swivel plate 516. Rotational force is thus transmitted to outer shaft 404. This rotational moment is sufficient to activate detent assembly 408. Balls 422 are urged into recesses 414, allowing outer shaft 404 to rotate independently from inner shaft 402. Outer shaft 404 rotates 60 degrees until balls 422 reenter successive aligning V-grooves 418, FIGS. 6 (*c-d*). Output pulley 424 couples outer shaft 404 to drive pulley 428 via belt 426. The ratio of output pulley 424 to drive pulley 428 is 3:1. As a result, the 60 degree rotation at outer shaft 404 is increased to a 180 degree rotation at roller 100.

When the 180 degree rotation is complete, advance arm 510 pivots on shaft 512 to move connecting link 518 and pawl lifting arm 520 into a normal run position. Thus, set screw 522 maintains pawl 524 out of engagement with ratchet 528, permitting drive assembly 300 to resume rotation of roller 100.

Due to the relatively high momentum imparted to roller 100 during the rapid rotation, greater than 60 degree rotation of segment 410 may occur, particularly if the force exerted by springs 414 is insufficient to stop relative rotation of segments 410 and 412. To prevent over-rotation, an escapement may be employed, cooperative with upper and lower segments 410, 412.

Roller 100 next rotates in contact with non-round article 22. FIG. 6 (*e-g*). As a result, Label 24 is completely transferred from roller 100 to article 22. As with the web roller transfer, the relative speeds of article 12 and roller 100 are adjusted for optimum label shrinking or stretching. The non-round turret of the prior art, as cited above, provides for adjustment of article conveyance speed.

Figure 7:
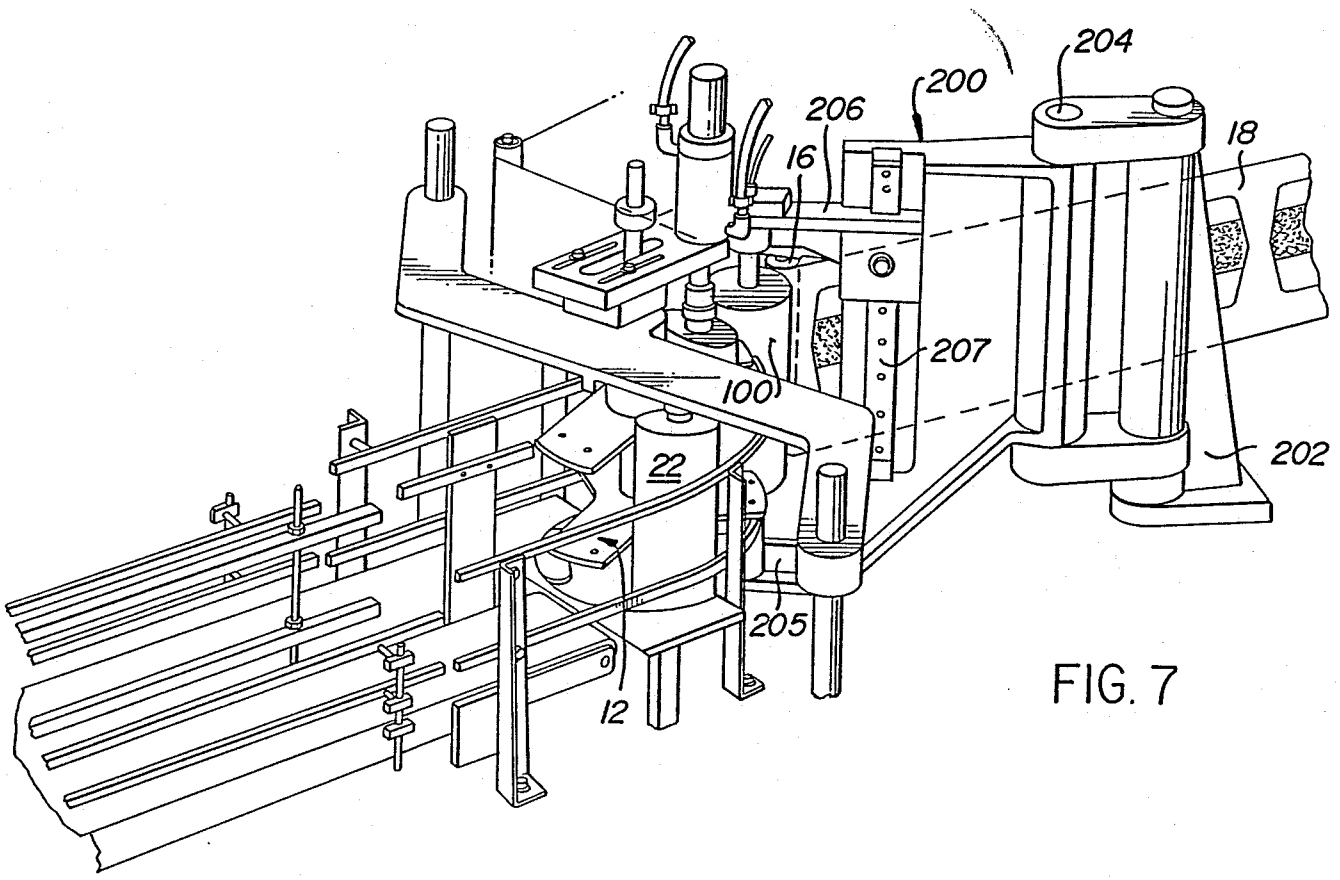
FIG. 7 is a perspective view of portions of a decorator, including the web, platen roller, roller, turret, and conveyor.

FIG. 7 illustrates the disposition of roller 100 between platen assembly 14 and article 22. Shown is a turret 12 for the conveyance of non-round articles.

DECORATION OF ROUND ARTICLES

Round articles, such as round plastic bottles, may be decorated in a different manner than non-round articles. In this procedure, transfer roller 16 and article 22 rotate against opposite sides of roller 100, wherein the label is transferred from web 18 to article 22 in a continuous manner.

As described above, drive assembly 300 imparts a timed reciprocating rotation to roller 100. Advance arm 510 is disenabled, for example by removing cam follower 506. Consequently, the 180 degree rapid rotation will not occur; pawl 524 will remain out of engagement with ratchet 528, and detent assembly 408 will operate solely to link inner and outer shafts 402 and 404.

Figures 8A, 8B, 8C, 8D, 8E, 8F, 8G:
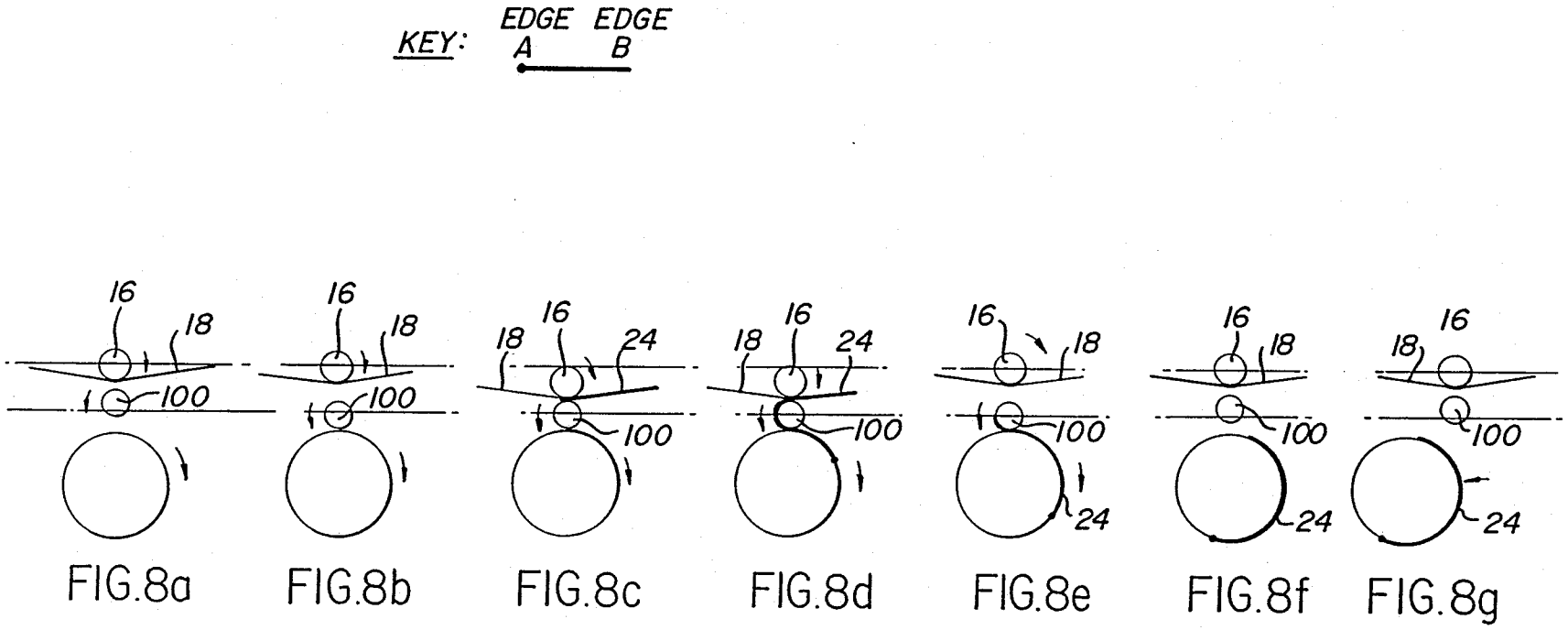
FIG. 8 is a schematic of the sequence of events in labelling a round article.
Figure 9:
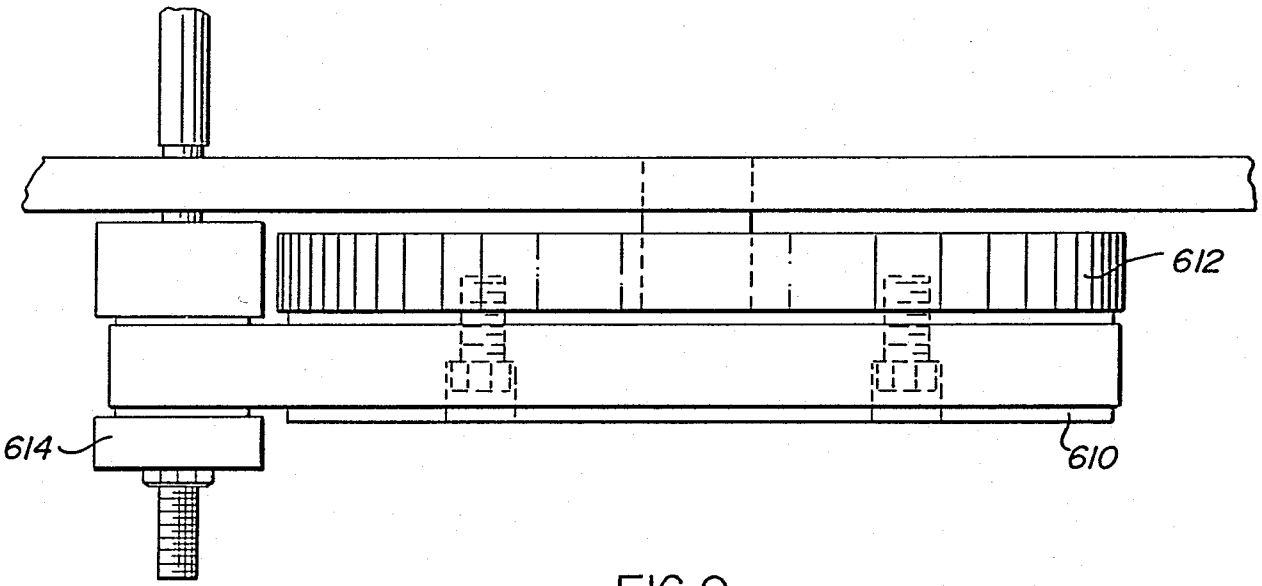
FIG. 9 is a side view of the turret modification for decorating round articles.

As the labelling cycle begins, transfer roller 16 is in the back position. If the article is a plastic bottle, it is inflated at this time. As shuttle 20 begins its stroke, roller 100 and article 22 are caused to begin rotation. FIG. 8 (*a*). Turret 12 is modified so that the direction of round article rotation matches the direction of roller 100. As shown in FIG. 9, a change pulley 610, serving to provide for bottle rotation, is mounted to pinion gear 612, described as pinion gear 61, FIG. 8, of U.S. Pat. No. 4,405,403. Bottle drive pulley 614 is coupled to change pulley 610 via a belt. In this manner, the article is caused to rotate clockwise, as viewed from above.

Next, linking arm 212 pivots support 200 towards turret 12 causing intermediate roller 100 to rotate in contact with article 22. FIG. 8 (*b*). As with the decoration of non-rounds, web/roller speed ratio is adjusted, in this application by modification of pulley 306 diameter. As web 18 advances, platen 14 and transfer roller 16 move forward pressing web 18 into contact with intermediate roller 100, wherein label 24 is transferred to intermediate roller 100. FIG. 8 (*c-d*).

In the round decorating procedure, the edge A of label 24 contacts the article first. In contrast, in the non-round decorating procedure, edge B of Label 24 contacts first. Round articles do not require the 180 degree rapid rotation because the article can easily be rotated opposite the rotational direction of the turret during the decorating step. Thus, in the round procedure, label 24 is applied from edge A to edge B. FIG. 8 (*d-e*). It should be noted that if long enough, Label 24 is adhered to web 18, roller 100, and article 22 simultaneously during the transfer process. As a result, relatively long labels can be transferred to round articles. Label length is important, however, in decorating non-rounds. In the non-round procedure, Label 24 must transfer entirely to roller 100, therefore label length cannot be greater than the roller circumference. Hence, a roller having a diameter of 2 inches could transfer a label of approximately 6 inches in length. In the round decorating procedure, roller 100 diameter is not a limiting factor; a roller 100 diameter of 1.25 inches, for example, can be used to transfer long and short labels. In addition, rapid rotation assembly 500 may optionally be employed to decorate round articles having correspondingly short label lengths.

Drive assembly 300 enables control and modification of roller 100 speed, however, label application can be achieved where roller 100 is permitted to rotate freely. In the decoration of round articles, it is Possible to drive roller 100, and even article 22, via web 18. Since roller 100 is in pressure contact with web 18, there may be sufficient friction to drive the roller. Since roller 100 is in contact with article 22, the later may additionally be driven. In a like manner, it can be seen that one of the carrier, roller 100, or article may drive the remaining two elements. The invention can apply such labels at low transfer forces, as opposed to the high transfer forces of pad systems. This is particularly advantageous in decorating fragile articles. Moreover, the present invention can decorate round containers with great reliability, and can apply a label in one transfer step over 360 degrees of the article surface.

It should be understood that in the decoration of non-round containers, the turret can be rotated in an indexing or continuous manner. In the round decorating procedure, the turret is stationary while the article is rotated for decoration. In contrast, there is no need to stop the turret in the non-round procedure, since the turret rotates the article past the decorating site.

Figure 11:
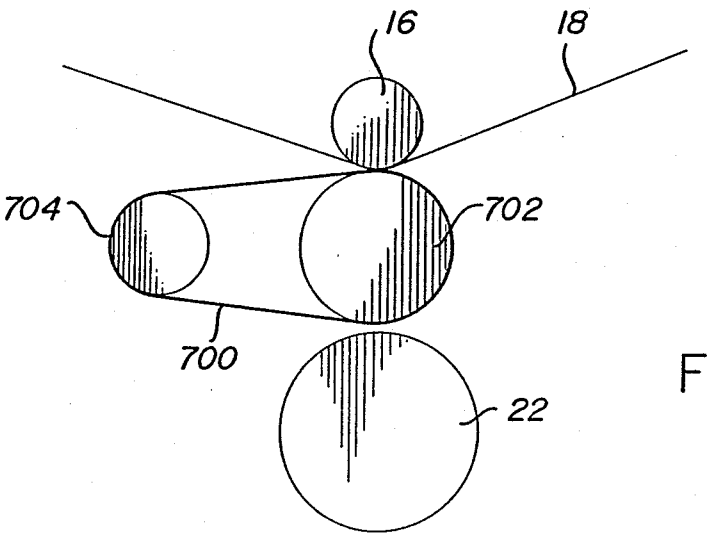
FIG. 11 is a plan view of an alternative roller configuration.

The invention may be carried out using a variety of alternative transferring configurations. For example, a belt 700 may be substituted for roller 100. As shown in FIG. 11, belt 700 passes around two rollers 702, 704. This intermediate transfer assembly provides for transfer of increased label lengths without increasing the transfer roller diameter.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention a set forth in the appended claims.

What is claimed is:

1. Apparatus for applying labels to articles, comprising:

means for advancing a label disposed on a carrier to a transfer site; and means for operating a transfer roller against said carrier, a rotational member with a displaceable axis at the transfer site operative to remove the label from the carrier;

wherein said rotational member applies the labels to the articles said displaceable axis providing for displacement of said roller away from said articles.

2. Apparatus of claim 1, further comprising:

means for heating said rotational member.

3. Apparatus of claim 1 further comprising:

a second rotational member disposed about the non-label side of the carrier; and, means for heating said second rotational member;

wherein said second rotational member heats and supports said carrier as said first rotational means removes the label from said carrier.

4. Apparatus of claim 1, wherein said rotational member comprises:

a heater core of heat transmittable material; and, a heat generating element disposed within, and in heat transmitting contact with, said heater core.

5. Apparatus of claim 1, wherein said rotational member comprises:

a drive journal;

a cylinder attached to said journal;

a smooth elastomeric coating disposed about the surface of said cylinder; and, a heater disposed within said cylinder;

wherein said drive journal and attached cylinder are rotatable about said heater.

6. Apparatus of claim 1, further comprising:

at least one heater disposed about the exterior of said rotational means, operative to heat same.

7. Apparatus of claim 1, wherein said means for advancing a label rotates said rotational member.

8. Apparatus of claim 1, wherein one of the following imparts motion to the remainder of the following:

means for advancing a label;

said rotational member;

the article.

9. Apparatus of claim 1, further comprising:

means for bidirectionally rotating said rotational member; and means for moving said rotational member from a position in contact with the carrier to a position in contact with the article.

10. Apparatus of claim 9, wherein said means for bidirectionally rotating said rotational member is operative to rotate same at more than one speed.

11. Apparatus of claim 9, wherein said means for rotating said rotational member comprise:

a first shaft coupled to said means for advancing said carrier;

a second shaft coupled to said means for rotating;

a detent assembly operative to link said first and second shafts; and, means for overriding said detent and driving said second shaft independently from said first shaft.

12. Apparatus of claim 11, further comprising:

means including an escapement for preventing over-rotation of said detent assembly.

13. Apparatus of claim 12 wherein said means for overriding said detent comprise:

a ratchet coupled to said second shaft;

a pawl engageable with said ratchet; and means for circumferentially driving said pawl in engagement with said ratchet.

14. Apparatus of claim 1, further comprising:

means for positioning said rotational member, comprising:

a base;

a pivot connected to said base; and upper and lower support members coupled to said pivot, rotatably connected to said rotational means; and means for pivoting said upper and lower support members.

15. Apparatus of claim 14 further comprising:

an adjusting key cooperative with said upper support member;

wherein the distance between upper and lower support members may be varied to accommodate different rotational member heights.

16. Apparatus of claim 14 wherein said means for positioning further comprises:

a pivotable bracket having a radiused slot disposed therein;

a link having one end connected to one of said upper and lower support members, and the other end slidably disposed within said radiused slot; and, means for adjusting the disposition of said link end within said slot.

17. Apparatus of claim 1, further comprising:

means for rotating said articles past the labeling site in a continuous manner.

18. Apparatus of claim 1, wherein said carrier is in contact with said rotational member, and said rotational member is in contact with said article, as said label is transferred from said carrier to said article.

19. Apparatus of claim 1, wherein said rotational member comprises:

at least two rollers;

a widened belt rotatably mounted around said rollers.

* * * * *